United States Patent [19]

Pellaton

[11] 4,244,252

[45] Jan. 13, 1981

[54] ONION CONVEYOR AND SLICER

[75] Inventor: Roy C. Pellaton, Stockton, Calif.

[73] Assignee: Guntert & Pellaton, Inc., Stockton, Calif.

[21] Appl. No.: 28,105

[22] Filed: Apr. 9, 1979

[51] Int. Cl.[3] ..... B26D 4/46; B26D 4/50

[52] U.S. Cl. ..... 83/356.3; 83/437; 83/592; 241/92

[58] Field of Search ..... 83/155, 355, 356.3, 83/437, 591, 592; 241/92

[56] References Cited

U.S. PATENT DOCUMENTS

| | | | |
|---|---|---|---|
| 905,960 | 12/1908 | Vavruska | 83/417 X |
| 1,466,105 | 8/1923 | Trubisky | 83/592 |
| 1,789,012 | 1/1931 | Matthias | 83/417 |
| 4,198,887 | 4/1980 | Williams | 83/356.3 |

*Primary Examiner*—J. M. Meister

*Attorney, Agent, or Firm*—Naylor, Neal & Uilkema

[57] ABSTRACT

Whole oriented onions are sliced in a slicer by holding the onions on a horizontal cutter-bearing plate and by rotating the plate to continuously remove slices from the lower ends of the onions until the onions are fully sliced. Non-oriented onions are recirculated between a feed hopper and the conveyor leading to the slicer.

8 Claims, 13 Drawing Figures

ONION CONVEYOR AND SLICER

SUMMARY OF THE INVENTION

An object of the invention is to provide an onion slicer with new and improved onion positioning and slice-feeding follower means.

A further object of the invention is to provide onion conveyor means for an onion slicer which delivers oriented onions for slicing and which recirculates non-oriented onions.

Still a further object of the invention is to provide in an automatic onion slicer a feed hopper with new and improved means to feed onions from the hopper to a conveyor which feeds the slicer.

Another object of the invention is to provide an automatic onion slicer with adjustable onion-retaining pocket members to obtain optimum slicing efficiency.

Another object of the invention is the provision in an automatic onion slicer of means for preventing the stacking of the onions during the course of their travel to the slicer.

These and other objects and advantages of the invention will be apparent from the following description taken in conjunction with the drawings forming part of this specification, and in which.

DESCRIPTION OF THE INVENTION

Figure 1:
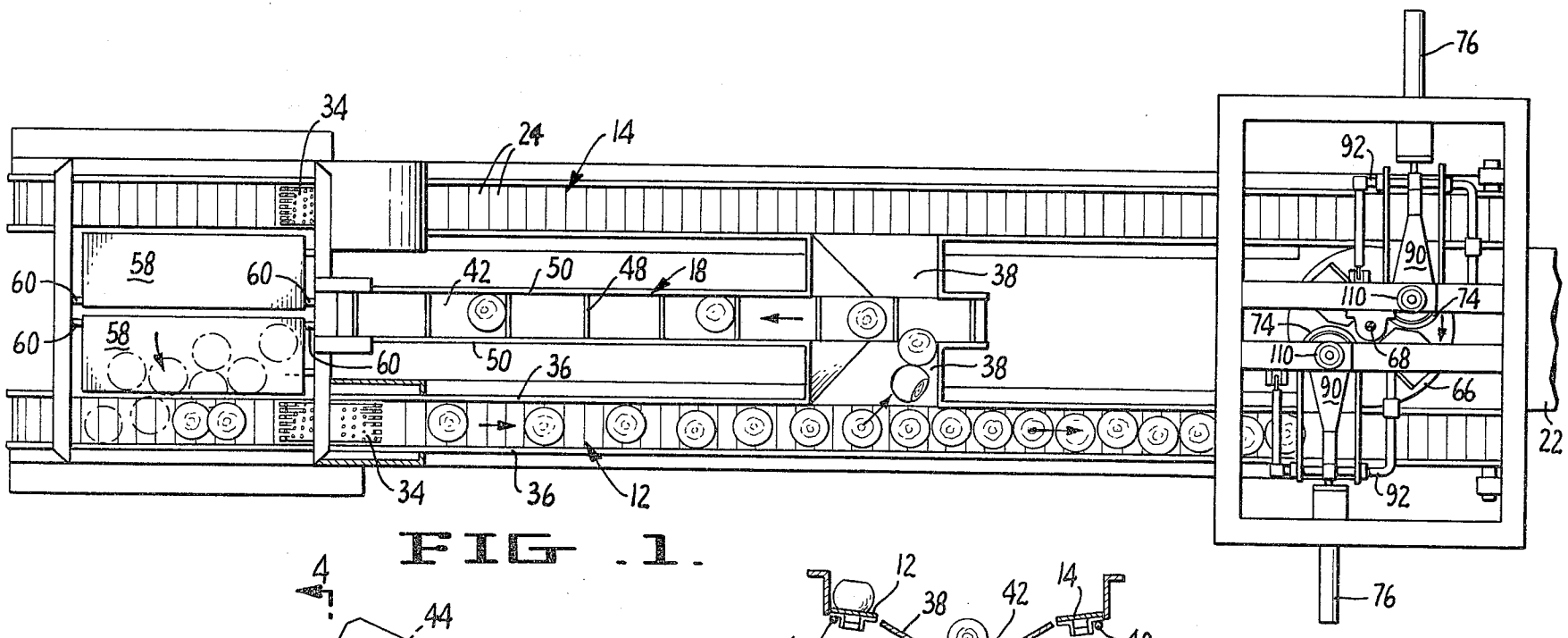
FIG. 1 is a top plan view of the onion feeder and slicer of the invention.
Figure 3:
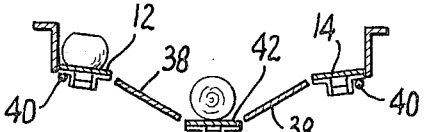
FIG. 3 is a detail view taken along lines 3—3 of FIG. 2.
Figure 2:
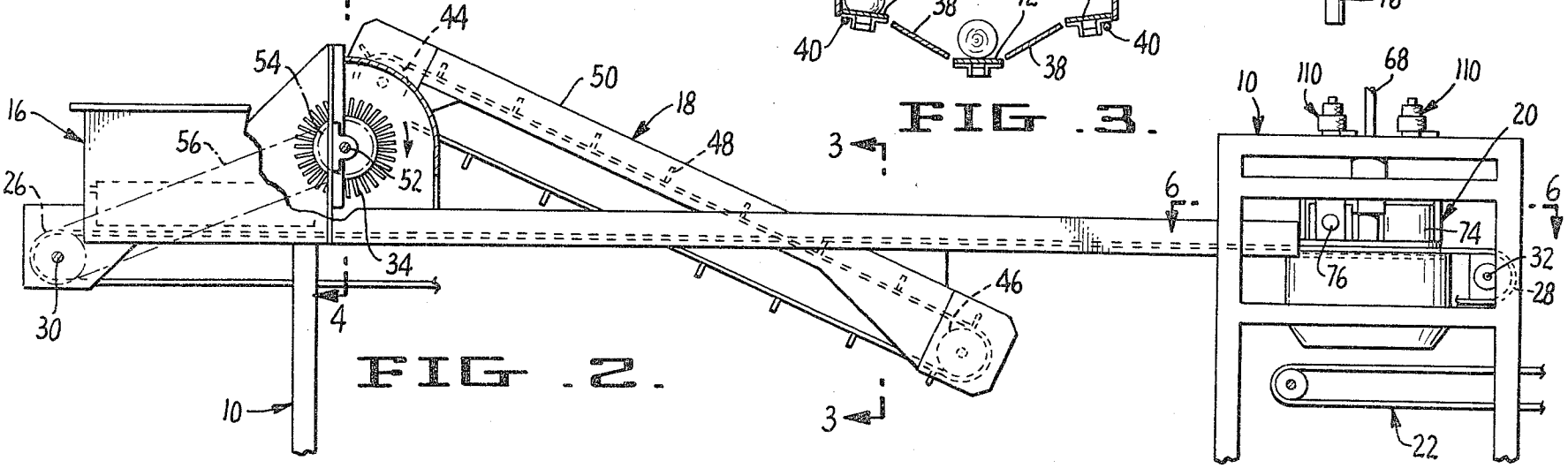
FIG. 2 is a view in side elevation of the same.
Figure 5:
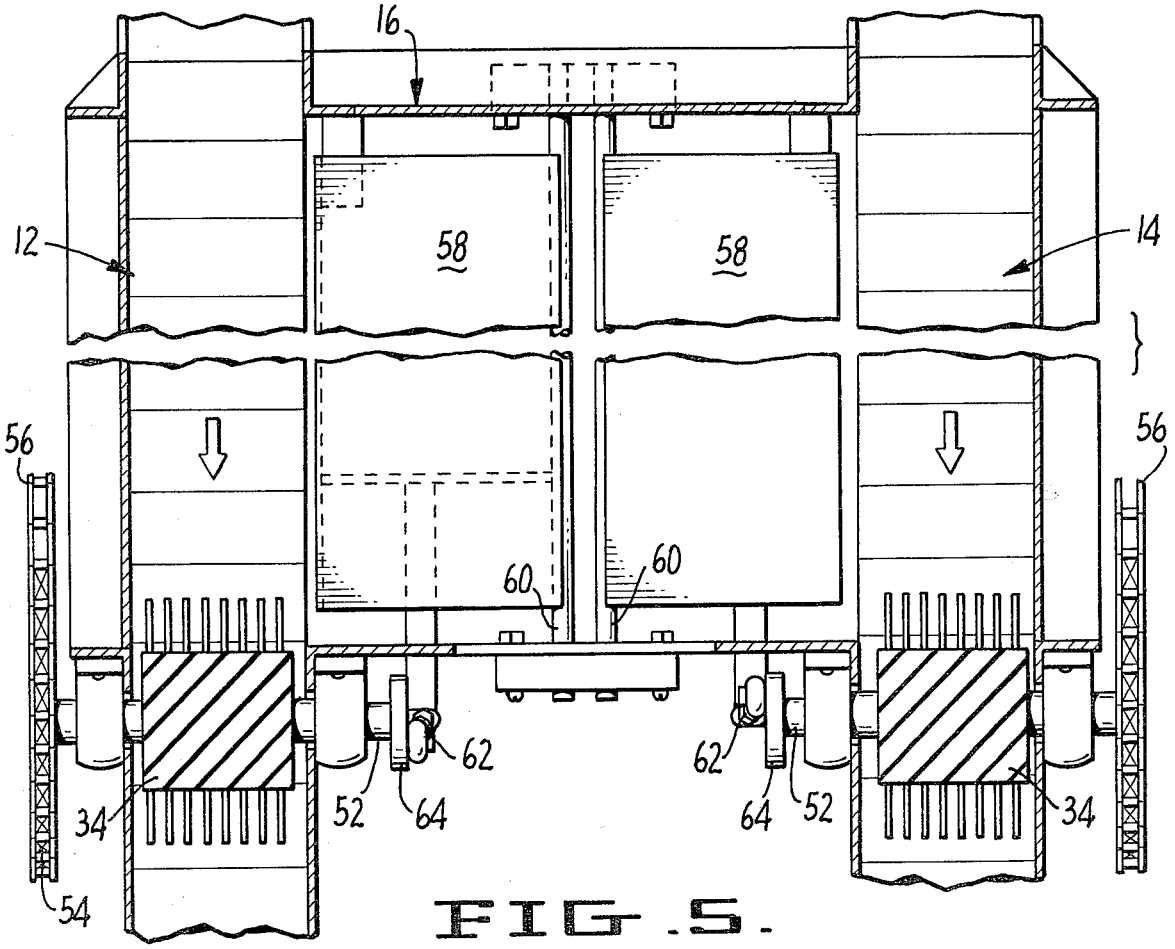
FIG. 5 is a view taken along lines 5—5 of FIG. 4.

The machine comprises a support frame 10, a pair of horizontally directed feed conveyors 12 and 14, hopper 16, return conveyor 18, slicer 20, and onion-slice removal conveyor 22.

Figure 4:
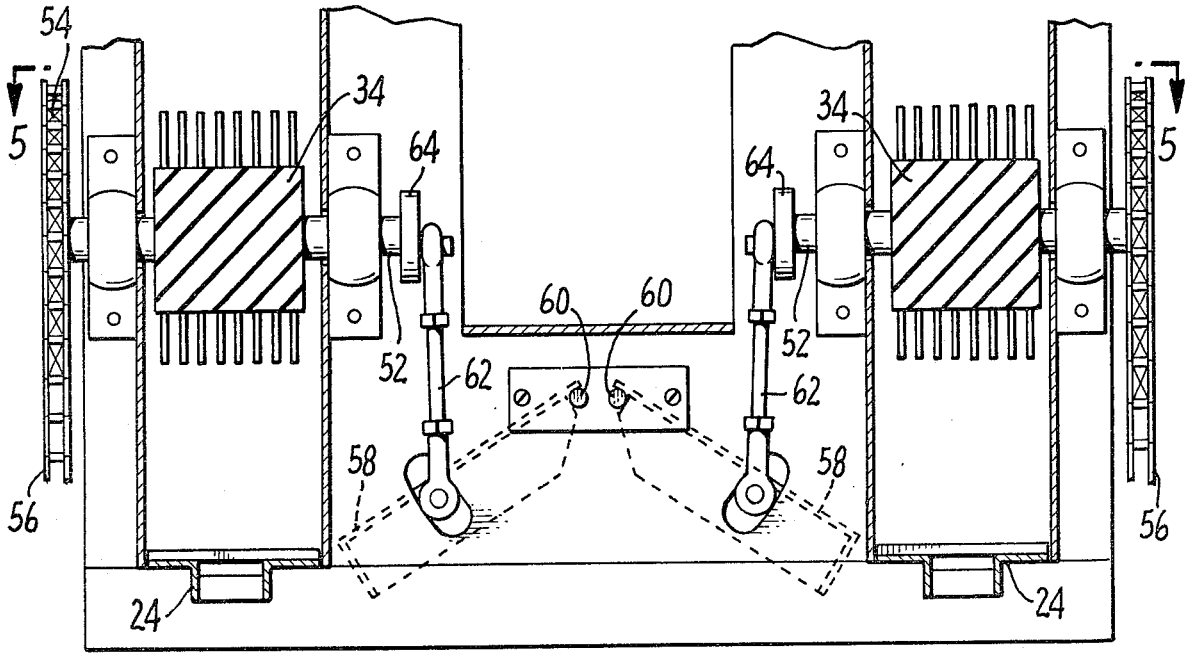
FIG. 4 is an enlarged view taken along lines 4—4 of FIG. 2.
Figures 6, 7, 8:
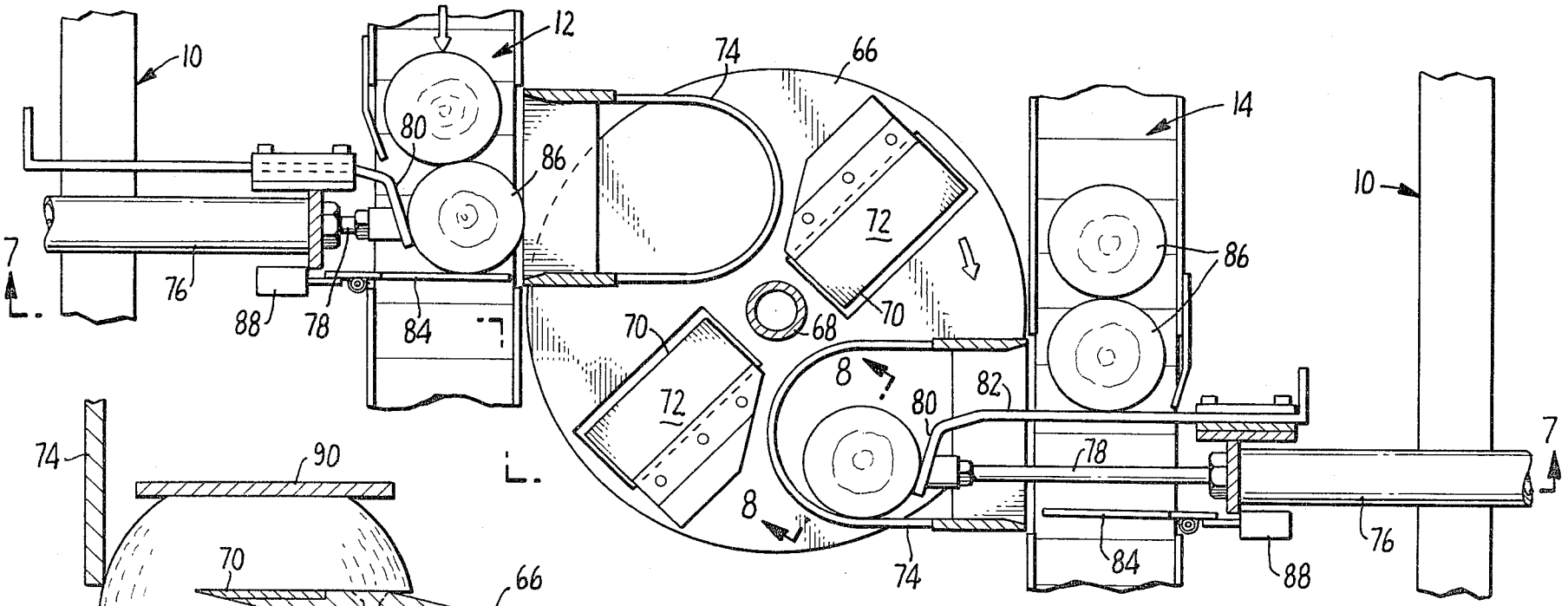
FIG. 6 is an enlarged view taken along lines 6—6 of FIG. 2.
FIG. 7 is a view taken along lines 7—7 of FIG. 6.
FIG. 8 is an enlarged view taken along lines 8—8 of FIG. 6.
Figure 9:
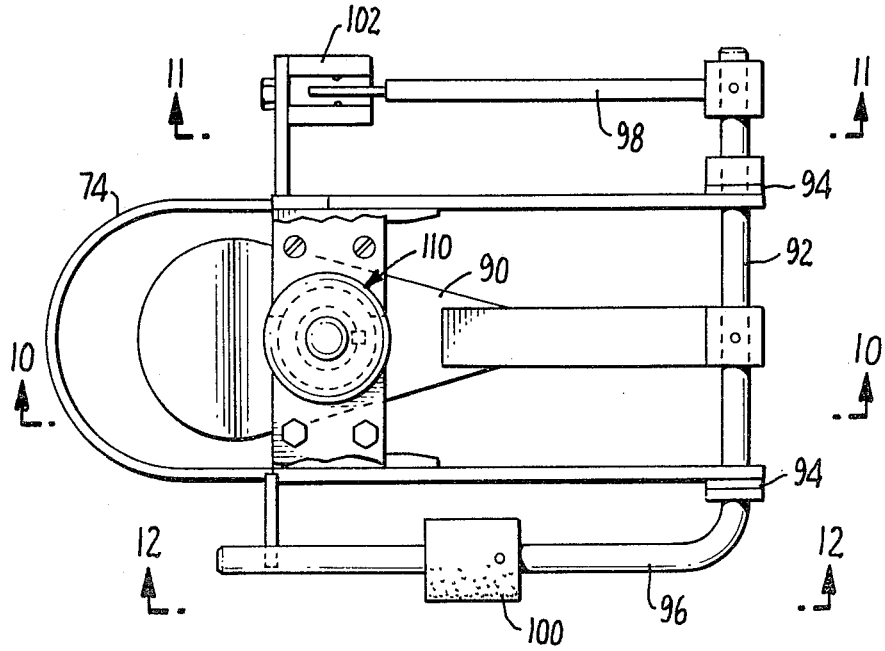
FIG. 9 is a top plan view of an onion positioning pocket and hold-down arm means.
Figure 11:
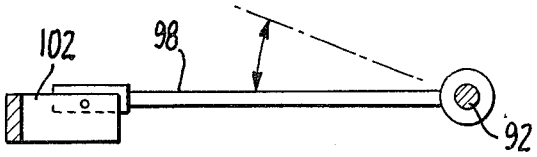
FIG. 11 is a view taken along lines 11—11 of FIG. 9.
Figure 12:
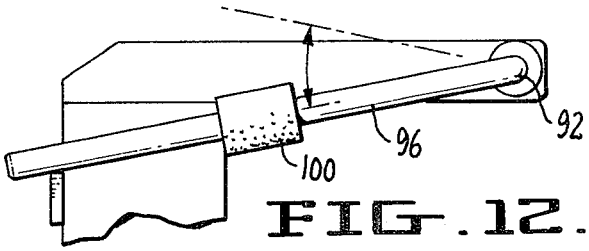
FIG. 12 is a view taken along lines 12—12 of FIG. 9.

The conveyors 12 and 14 are table top chain conveyors having carrier elements 24 (FIG. 4). The conveyors are trained about sprockets 26 and 28 supported on shafts 30 and 32 journalled in the support frame 10. Intermediate the shafts 30 and 32, the conveyors extend through the hopper 16, beneath anti-stacking rolls 34, between retainer wall members 36, past chutes 38, and past slicer 20.

The conveyors 12 and 14 travel over tipping rails 40 which are positioned laterally adjacent the chutes 38. The inner retainer walls 36 for the conveyors 12 and 14 are provided with openings at the chutes 38 so that under circumstances hereinafter described onions may travel off of the conveyors 12 and 14, down the chutes 38, and onto the conveyor 18.

Conveyor 18 comprises a belt conveyor 42, drive and driven sprockets 44 and 46, cleat members 48 carried by the conveyor, and retainer wall members 50 which are provided with access openings at the lower ends of chutes 38.

The anti-stacking rolls 34 are fixedly mounted on shafts 52 journalled to the frame 10. The rolls are driven through sprockets 54 fixed to the shafts 52 and having a chain drive connection 56 with the sprockets 26. A suitable drive connection is also provided between sprockets 26 and sprockets 44 of conveyor 18. The entire machine is operated by a suitable drive motor, not shown.

Forming the bottom of the hopper 16 along with the conveyors 12 and 14 is a pair of plate members 58 attached to pivotal supports 60. Plate members 58 are provided with pitman arms 62 attached to eccentrics carried by shafts 52. This arrangement imparts up and down arcuate movement to the plate members 58 which serves to prevent the bridging of onions in the hopper and assists in the transfer of onions from the hopper onto the conveyors 12 and 14.

The slicer comprises turntable 66 fixedly connected to vertical driven shaft 68 suitably mounted in bearing members carried by the support frame 10, cutter blades 70 carried by blade holder means 72, U-shaped pocket members 74 adapted to position and hold the onions for slicing, power cylinders 76 having cylinder rods 78 carrying pusher plate elements 80 and trailing arm members 82. Stop members 84 are provided for the onions 86. These stop members are responsive to contact pressure of the onions to actuate through sensing means 88 the operation of cylinders 76. Associated with the pocket members 74 are onion hold-down members 90 operable to pressingly engage the onions within the pocket members 74 and to travel downwardly with the onions as they are depleted by the slicing action of cutter blades 70.

As shown in FIGS. 8–12, the hold-down arms 90 are fixedly attached to rods 92 journalled in supports 94. The rods 92 are provided with extension members 96 and 98, the former carrying counter-weights 100 and the latter being disposed in control relation to low force air trigger means 102 connected in series with the sensing means 88.

Figure 10:
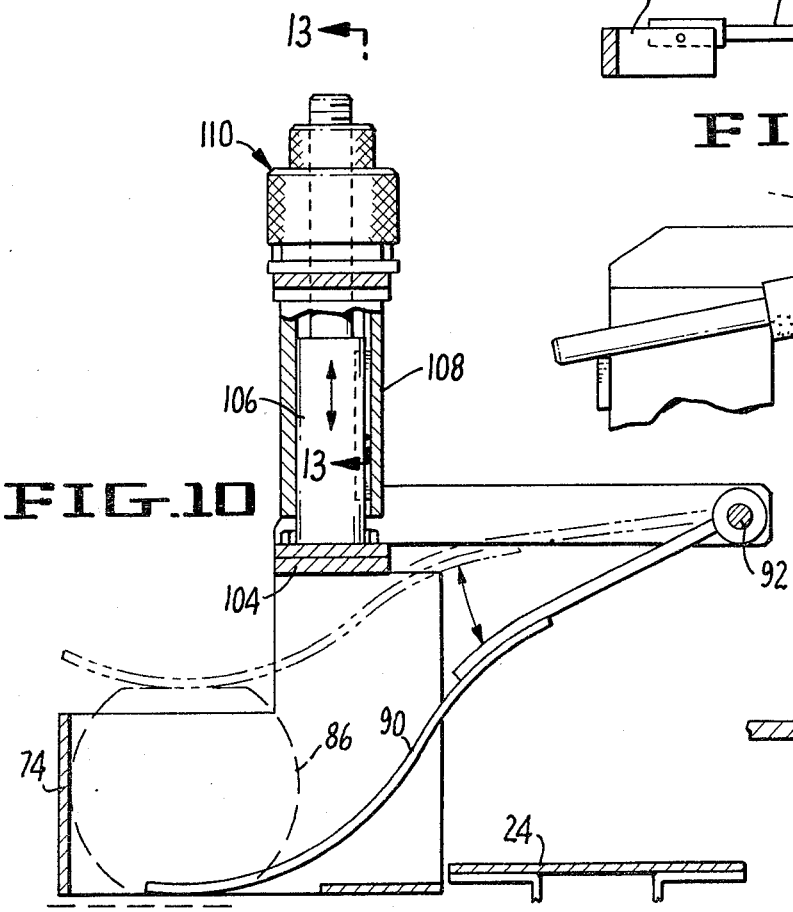
FIG. 10 is a view taken along lines 10—10 of FIG. 9.
Figure 13:
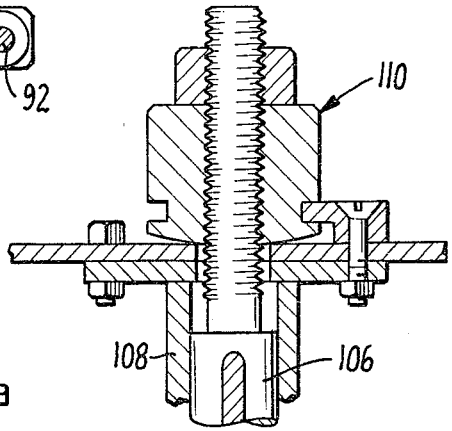
FIG. 13 is an enlarged view taken along lines 13—13 of FIG. 10.

The pocket members 74 are provided with means for their vertical adjustment, as shown in FIGS. 10 and 13. This is important in order that the clearance between the pocket members and the knives may be held to a minimum in order to produce good slicing. The pocket members 74 are attached to cross members 104 which are in turn carried by rod members 106, the latter being slidably disposed within sleeves 108 and having connected thereto adjustment nut means 110.

The operation of the onion feeder and slicer is as follows. Onions which have been peeled and have had the root and crown surfaces well-defined by cutting are fed from the hopper 16 onto the conveyors 12 and 14 assisted by the oscillatory action of the hopper plates 58. The finger rolls 34 serve to scavenge back into the hopper stacked onions. Single layers of oriented onions i.e. onions which are supported on either their root or crown surfaces are carried along the conveyors 12 and 14 until the lead onions engage the sensor-actuating stop members 84. This results in actuation of the cylinders and consequent movement of the leading onions by the pusher plates 80 into the pocket members 74. The onions within the pocket members are firmly positioned by the joint holding action of pocket members 74 and hold-down arms 90. The onions are thus firmly held against the rotating plate 66 as onion slices are removed by the blades 70 and deflected through the openings 112 in plate 66 onto the slice collecting conveyor 22.

As the cylinder rods 78 move the lead onions into the pocket members 74, the trailing arm elements 82 of the pusher plate elements 80 retain the balance of the onions against further forward movement. After delivery of an onion to the pocket member 74 each cylinder 76 is automatically actuated to retract its rod 78. The rod remains retracted until another onion is in place opposite the pocket member 74 and the pocket member is ready to receive another onion. The cycle then repeats itself.

Non-oriented onions, i.e. those which have not settled on either their root or their crown surfaces and are instead lying on their curved surfaces, roll off of the conveyors 12 and 14 down the chutes 38 and onto the conveyor 18 for return to the hopper 16 under the influence of the tipping rails 40.

The infeed cylinders 76 are provided with low force air triggers which are activated by onions engaging stop members 84. When the arms 90 reach their lowest position of travel, i.e. when the onions in the pocket members have been fully sliced, the air trigger means 102 sends a signal. This signal together with the signal sent by engagement of an onion with a stop member 84 actuates the associated cylinder 76 to feed an onion to a pocket member.

The rotary plate or slicer wheel 66 should be operated for best results at 150–250 RPM. Higher speeds do not allow the onions to settle down for the next cut. Lower speeds do not provide a good cut.

While a preferred embodiment of the onion feeder and slicer has been shown and described, it is to be understood that the machine is subject to modification within the scope of the appended claims.

What is claimed is:

1. An onion slicer comprising a rotary plate, slicing knife means carried by said plate, an onion feed conveyor positioned to deliver onions tangentially to said plate, transfer means movable transversely of said conveyor operable to move onions from said conveyor onto said plate, means to position an onion on said plate for slicing by said knife means, means to continuously press said onion against said plate as it is sliced by said knife means, and means to convey onion slices away from said plate comprising an aperture in said plate to pass said slices as they are formed by said knife means.

2. The slicer of claim 1 including an onion feed hopper associated with said conveyor, means to transfer onions from said hopper onto the feed conveyor, a bypass conveyor adapted to receive non-oriented onions from the feed conveyor at a transfer station and return them to said hopper, and means to transfer non-oriented onions from said feed conveyor to said bypass conveyor.

3. The slicer of claim 2, said means to transfer onions from said hopper onto the feed conveyor comprising a cyclically movable wall member for said hopper operable to prevent the bridging of onions within said hopper.

4. An onion slicer comprising a horizontally disposed rotary plate, slicing knife means carried by said plate, means to position an onion on said plate for slicing comprising a U-shaped pocket member mounted above said plate, hold-down means to continuously press said onion against said plate as it is sliced by said knife means, and means to convey onion slices away from said plate comprising an aperture in said plate to pass said slices as they are formed by said knife means.

5. The slicer of claim 4, said hold-down means comprising a pivotally mounted arm member extending lengthwise of said pocket member and adapted to be cammed upwardly by the movement of an onion into said pocket member, and means associated with said hold-down means operable to continuously press said arm member onto an onion in said pocket member until the onion has been fully sliced.

6. The slicer of claim 5 including a feed conveyor to feed onions along a path extending at a right angle to the open end of said U-shaped pocket member, and pusher means to move onions one at a time off of said feed conveyor into said pocket member.

7. The slicer of claim 6, including means to retract said pusher means, means to position another onion in line with the retracted pusher means for movement into said pocket member, and means responsive to pivotal movement of said arm member through a predetermined angle as an onion is fully sliced to actuate said pusher means and position another onion within said pocket member for slicing.

8. An onion slicer comprising a horizontally disposed rotary plate, slicing knife means carried by said plate, means to position an onion on said plate for slicing comprising a pocket member open at the top and bottom mounted above said plate, and means to adjustably position said pocket member relative to said plate to control the clearance therebetween and thereby control slicing efficiency.

* * * * *